US010583976B2

(12) United States Patent
Timmers et al.

(10) Patent No.: US 10,583,976 B2
(45) Date of Patent: Mar. 10, 2020

(54) DUNNAGE CONVERSION MACHINE, HELICALLY-CRUMPLED DUNNAGE PRODUCT AND METHOD

(71) Applicant: Ranpak Corp., Concord Township, OH (US)

(72) Inventors: Mike J. Timmers, Landgraaf (NL); Raimond P. M. Demers, Landgraaf (NL)

(73) Assignee: Ranpak Corp., Concord Township, OH (US)

( * ) Notice: Subject to any disclaimer, the term of this patent is extended or adjusted under 35 U.S.C. 154(b) by 628 days.

(21) Appl. No.: 14/777,327

(22) PCT Filed: Mar. 14, 2014

(86) PCT No.: PCT/US2014/028869
§ 371 (c)(1),
(2) Date: Sep. 15, 2015

(87) PCT Pub. No.: WO2014/144452
PCT Pub. Date: Sep. 18, 2014

(65) Prior Publication Data

US 2016/0060014 A1 Mar. 3, 2016

Related U.S. Application Data

(60) Provisional application No. 61/801,876, filed on Mar. 15, 2013.

(51) Int. Cl.
*B65D 81/107* (2006.01)
*B31D 5/00* (2017.01)
(Continued)

(52) U.S. Cl.
CPC ..... *B65D 81/1075* (2013.01); *B31C 3/04* (2013.01); *B31C 11/02* (2013.01); *B31C 13/00* (2013.01);
(Continued)

(58) Field of Classification Search
CPC .... B31C 1/02; B31C 1/04; B31C 3/00; B31C 7/10; B31D 5/0039; B31D 5/0043; B31D 2205/0005
(Continued)

(56) References Cited

U.S. PATENT DOCUMENTS 2,933,122 A * 4/1960 Christman ..... B21D 47/00 493/966
4,012,932 A * 3/1977 Gewiss ..... B31D 5/00 264/287
(Continued)

FOREIGN PATENT DOCUMENTS

JP H09 239873 A 9/1997

OTHER PUBLICATIONS

International Preliminary Report of Patentability for PCT/US2014/028869, filed Mar. 14, 2014.
International Search Report for PCT/US2014/028869.

*Primary Examiner* — Michelle Lopez
*Assistant Examiner* — Chinyere J Rushing-Tucker
(74) *Attorney, Agent, or Firm* — Renner, Otto, Boisselle & Sklar, LLP

(57) ABSTRACT

A machine for converting a sheet stock material into a relatively less dense dunnage product includes both (a) a helical pre-form assembly having a cylindrical mandrel with a longitudinal axis and a guide member for guiding the sheet stock material from a supply thereof into a helical path along and around the mandrel so as to form a helical pre-form that rotates around the longitudinal axis and advances parallel to
(Continued)

the longitudinal axis; and (b) a restriction in the path of the pre-form that slows the advance and rotation of the pre-form past the restriction, the restriction causing the pre-form to retard longitudinal advancement, to twist upon itself, and to permanently deform as it moves past the restriction, thereby longitudinally and helically crumpling the pre-form.

15 Claims, 19 Drawing Sheets

(51) Int. Cl.
*B31C 3/04* (2006.01)
*B31C 11/02* (2006.01)
*B31C 99/00* (2009.01)
*B65D 81/09* (2006.01)

(52) U.S. Cl.
CPC ..... *B31D 5/0043* (2013.01); *B65D 81/09* (2013.01); *B31D 2205/0047* (2013.01); *B31D 2205/0076* (2013.01)

(58) Field of Classification Search
USPC ..... 493/350, 352, 407, 904, 967, 269, 283, 493/288, 299, 305
See application file for complete search history.

(56) References Cited

U.S. PATENT DOCUMENTS 5,906,569 A * 5/1999 Ratzel ..... B26D 1/245 493/363
6,523,331 B1 * 2/2003 Fresnel ..... B65B 9/14 493/273
6,626,821 B1 * 9/2003 Kung ..... A61M 1/122 600/16
2002/0082152 A1 * 6/2002 Manley ..... B31D 5/0047 493/464
2004/0050743 A1 3/2004 Slovencik et al.
2010/0285944 A1 * 11/2010 Weder ..... A41G 1/009 493/324
2010/0300639 A1 * 12/2010 Keller ..... B31D 5/0043 162/361
2012/0053040 A1 * 3/2012 Wetsch ..... B31D 5/0047 493/464
2012/0165172 A1 * 6/2012 Wetsch ..... B31D 5/0039 493/352

* cited by examiner

FIG. 20
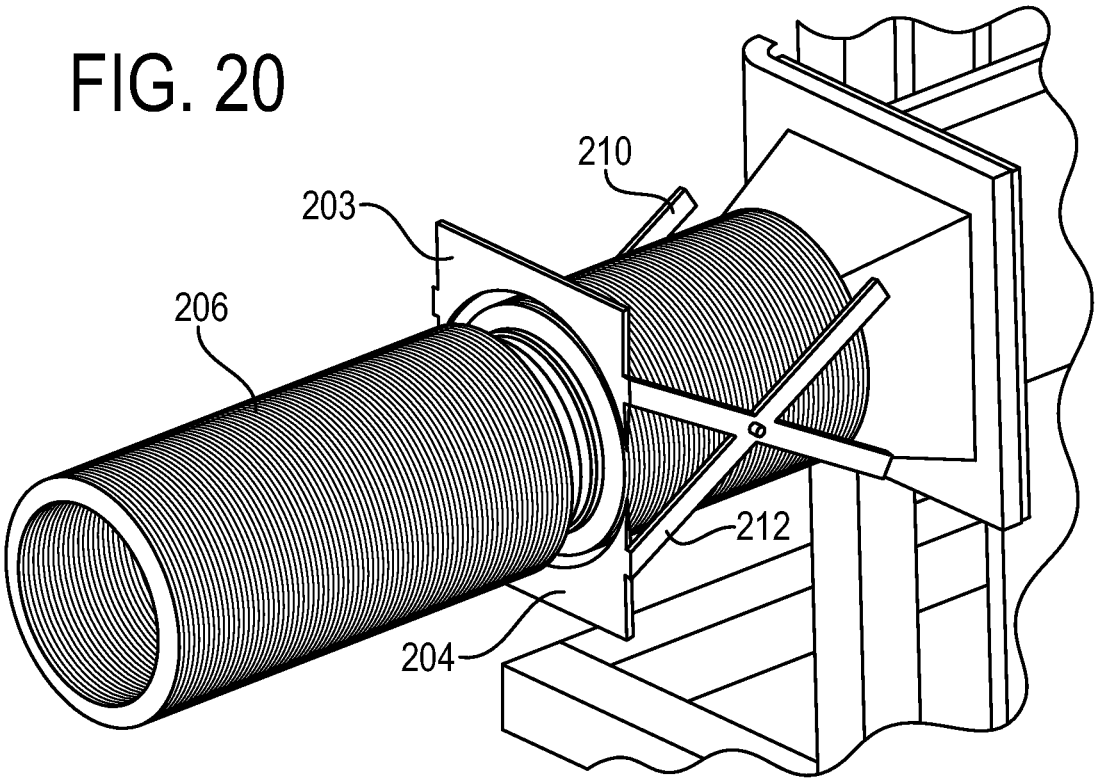
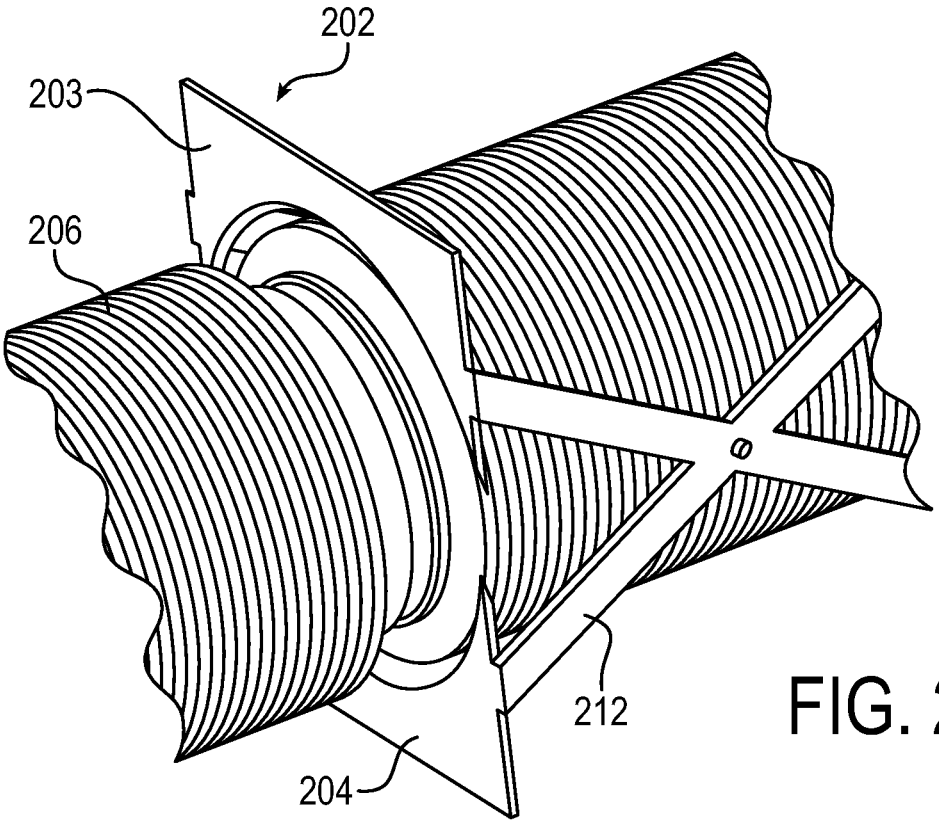
FIG. 21

DUNNAGE CONVERSION MACHINE, HELICALLY-CRUMPLED DUNNAGE PRODUCT AND METHOD

RELATED APPLICATIONS

This application is a national phase of International Application No. PCT/US2014/028869 filed Mar. 13, 2014, and published in the English language, and which claims the benefit of U.S. Provisional Application No. 61/801,876 filed Mar. 15, 2013.

FIELD OF THE INVENTION

This invention is generally in the field of machines that convert a stock material into a relatively less dense dunnage product, and more particularly to a machine, product and method for making a helically-crumpled dunnage product.

BACKGROUND

In the process of shipping one or more articles from one location to another, a packer typically places some type of dunnage material in a shipping container, such as a cardboard box, along with the article or articles to be shipped. The dunnage material partially or completely fills the empty space or void volume around the articles in the container. By filling the void volume, the dunnage prevents or minimizes movement of the articles that might lead to damage during the shipment process. The dunnage also can perform blocking, bracing, or cushioning functions. Some commonly used dunnage materials are plastic foam peanuts, plastic bubble pack, air bags and converted paper dunnage material.

A supply of dunnage material can be provided to the packer in advance, or the dunnage material can be produced as it is needed. Low volume applications typically have used dunnage materials such as plastic foam peanuts and manually-crumpled newspaper. Plastic foam peanuts are messy and occupy the same volume when being stored as when being used. Crumpled newspaper also is messy and requires the packer to manually crumple the newspaper. Alternatively, a dunnage conversion machine can be used to convert a supply of stock material, such as a roll or stack of paper, into a lower density dunnage product as it is needed by the packer. For example, U.S. Pat. No. 6,676,589 discloses a dunnage conversion machine that converts a continuous sheet of paper into a crumpled dunnage product.

SUMMARY

The present invention provides a helically-crumpled dunnage product, a method of making such a dunnage product, and a machine for converting a sheet stock material into the relatively less dense dunnage product. The helically-crumpled dunnage product is longitudinally and helically crumpled, providing lateral strength and increasing the cushioning ability of the dunnage product. Moreover, the machine and method provided by the invention allow for continuous production of the dunnage products and allow the dunnage products to be produced on demand, as needed, or produced in advance and dispensed in bulk.

Unlike prior dunnage products that were produced in advance and subsequently dispensed in bulk, specifically foam peanuts, the dunnage conversion machine provided by the invention allows the stock material to be shipped in a high-density configuration, as a roll or fan-folded stack, for example, and then converted into the lower-density dunnage product on site, where the dunnage will be put to use.

More specifically, the present invention provides a machine for converting a sheet stock material into a relatively less dense dunnage product, and that machine includes both (a) a helical pre-form assembly having a cylindrical mandrel with a longitudinal axis and a guide member for guiding the sheet stock material from a supply thereof into a helical path along and around the mandrel so as to form a helical pre-form that rotates around the longitudinal axis and advances parallel to the longitudinal axis; and (b) a restriction in the path of the pre-form that slows the advance and rotation of the pre-form past the restriction, the restriction causing the pre-form to retard longitudinal advancement, to twist upon itself, and to permanently deform as it moves past the restriction, thereby longitudinally and helically crumpling the pre-form.

The machine optionally can further include one or more of the following features: (i) where the helical pre-form assembly includes a drive belt extending around the mandrel, the mandrel and the drive belt cooperating to define the helical path for the sheet stock material; (ii) where the mandrel has a distal end portion with a reduced diameter; (iii) where the restriction includes an interface surface that extends into the path of the pre-form, and the interface surface is spring-biased toward the mandrel and is movable between a position adjacent the mandrel and a position further from the mandrel; (iv) where the longitudinal axis extends from an upstream end of the mandrel where the sheet stock material first engages the mandrel and a downstream end of the mandrel where the pre-form crumples between the distal end portion of the mandrel and the restriction, and the restriction has a cross-section along the longitudinal axis that defines a larger gap between the mandrel and the restriction at an upstream side of the restriction and a smaller gap between the mandrel and the restriction at a downstream side of the restriction; (v) comprising a guide cone downstream of the restriction, aligned with the mandrel, and oriented with its apex facing the mandrel; (vi) comprising a separating mechanism between the restriction and the guide cone to separate sections of crumpled pre-form to form discrete dunnage products; (vii) comprising a support for a supply of sheet stock material; (viii) comprising a supply of sheet stock material; (ix) where the supply of sheet stock material is provided in the form of a cylindrical roll or a rectangular fan-folded stack; (x) comprising a guide having an axis that is transverse the longitudinal axis of the mandrel to guide sheet stock material from the supply to the mandrel along a path that intersects the mandrel at an acute angle relative to the longitudinal axis; and (xi) comprising a guide for a tape to join adjacent sections of the strip of sheet material.

The present invention also provides a dunnage product, comprising a sheet wound along a helical path into a helical configuration with adjacent edge portions joined together to form a helical seam, the sheet being permanently deformed by having randomly disposed helical and circumferential folds in the sheet.

The dunnage product may further include one or more of the following features: (i) where the sheet includes paper; and (ii) where adjacent sections of the sheet material are joined together.

The present invention also provides a method of making a dunnage product or any other product claim that includes the steps of: (a) helically winding a strip of sheet material around a mandrel to form a helical pre-form; and advancing the pre-form along the mandrel in a direction parallel to a longitudinal axis of the mandrel; and (b) longitudinally and helically crumpling the helical pre-form to form a dunnage product.

The method may include one or more of the following additional features: (i) where the winding step includes advancing a strip of sheet material along a helical path using a drive belt that extends around the mandrel; (ii) where the crumpling step includes restricting the rate of advancement of the helical pre-form to cause the sheet material to crumple; and (iii) comprising the step of separating discrete sections of the crumpled pre-form after the crumpling step.

The present invention further provides a dunnage product produced by a process that includes the steps of: (a) helically winding a strip of sheet material around and along a mandrel to form a helical pre-form that advances around the mandrel and along the mandrel in a longitudinal direction; and (b) retarding the advance of the pre-form to longitudinally and helically crumple the helical pre-form to form a dunnage product.

The present invention further provides a dunnage conversion machine, that includes (a) means for helically winding a strip of sheet material around and along a mandrel to form a helical pre-form that advances around the mandrel and along the mandrel in a longitudinal direction; and (b) means for retarding the advance of the pre-form to longitudinally and helically crumple the helical pre-form to form a dunnage product.

Finally, the present invention provides a dunnage conversion machine that includes means for helically feeding a strip of sheet material and means for retarding the advance of the sheet material to cause the sheet material to randomly crumple.

The foregoing and other features of the invention are hereinafter fully described and particularly pointed out in the claims, the following description and the annexed drawings setting forth in detail one or more illustrative embodiments of the invention. These embodiments, however, are but a few of the various ways in which the principles of the invention can be employed. Other objects, advantages and features of the invention will become apparent from the following detailed description of the invention when considered in conjunction with the drawings.

BRIEF DESCRIPTION OF THE DRAWINGS

FIG. 20 is a perspective view of an alternative separating mechanism for a dunnage conversion machine provided by the invention.

FIG. 21 is an enlarged perspective view of a portion of FIG. 20.

DETAILED DESCRIPTION

Figure 1:
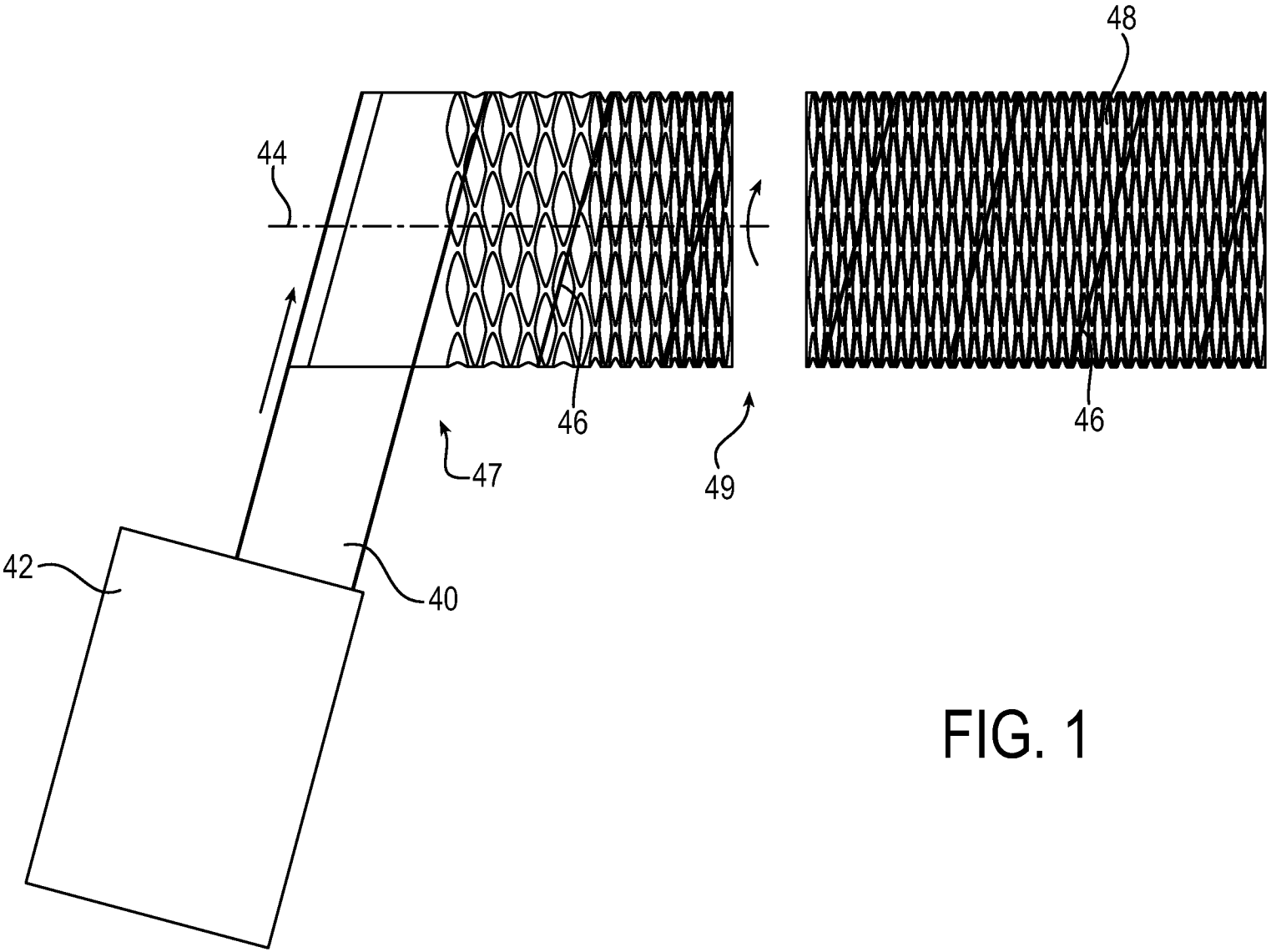
FIG. 1 is a schematic illustration of a dunnage production process provided by the present invention.
Figure 2:
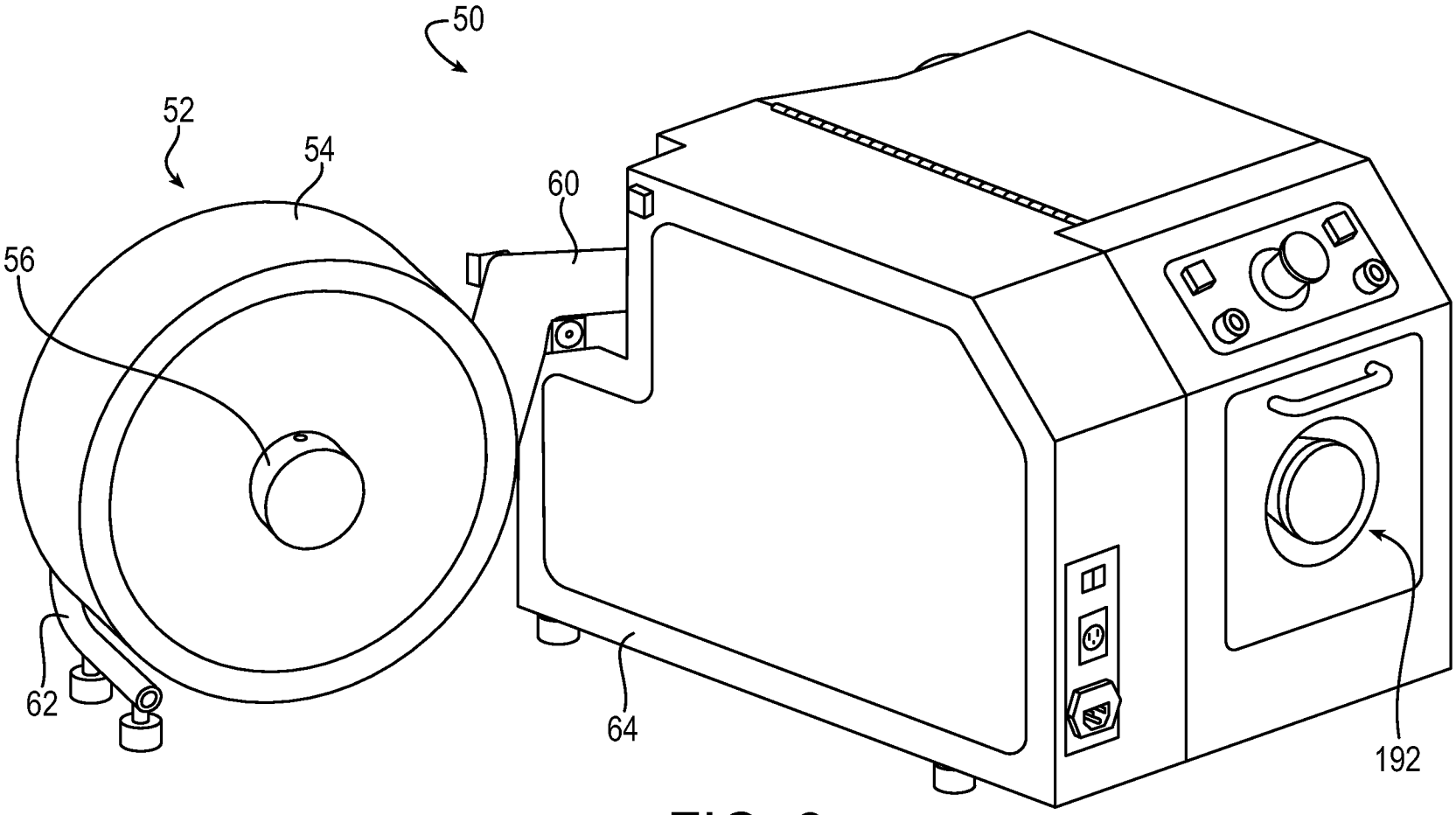
FIG. 2 is a front perspective view of an exemplary dunnage conversion machine provided by the invention.
Figure 3:
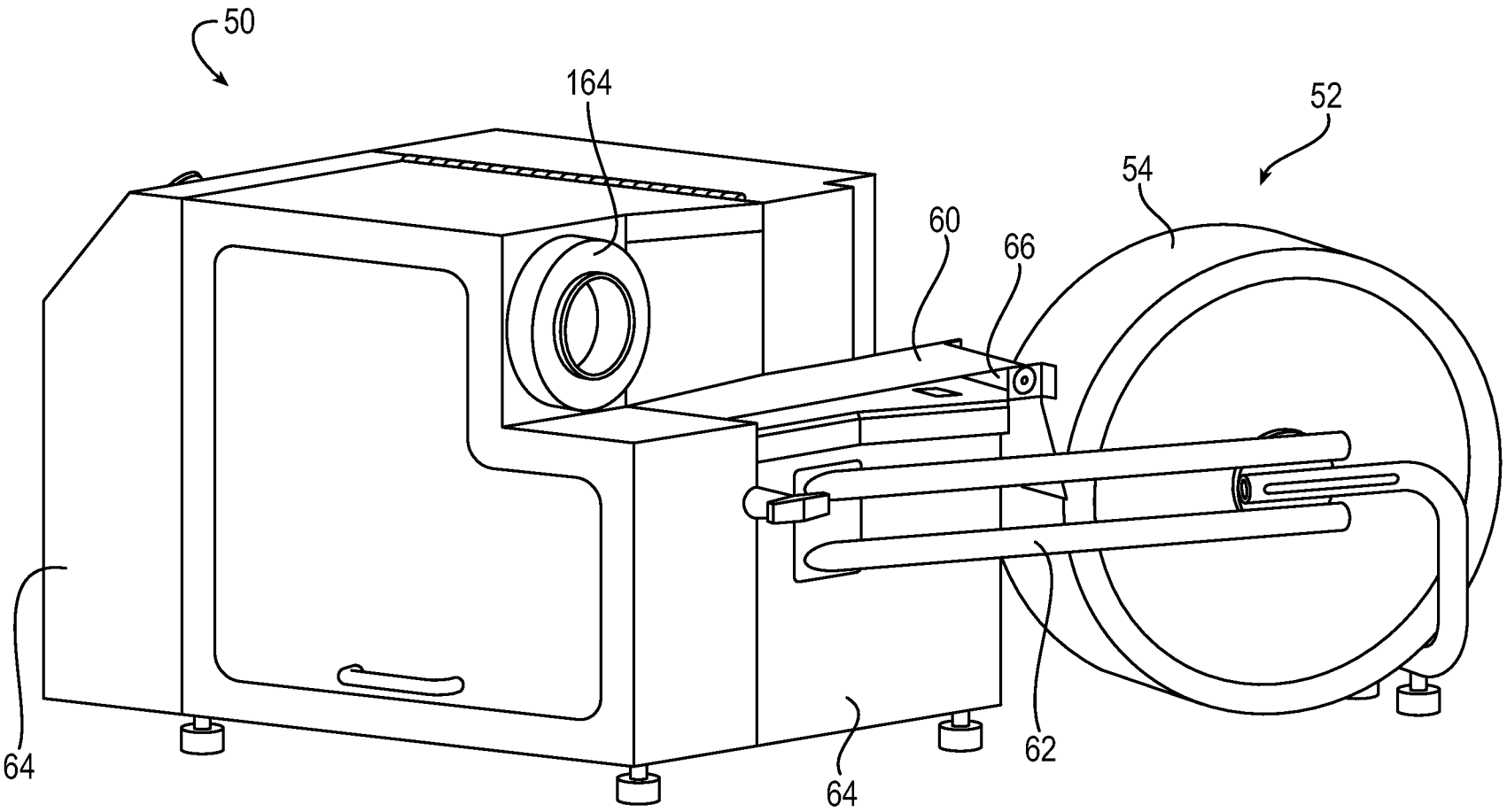
FIG. 3 is a rear perspective view of the dunnage conversion machine of FIG. 2.
Figure 4:
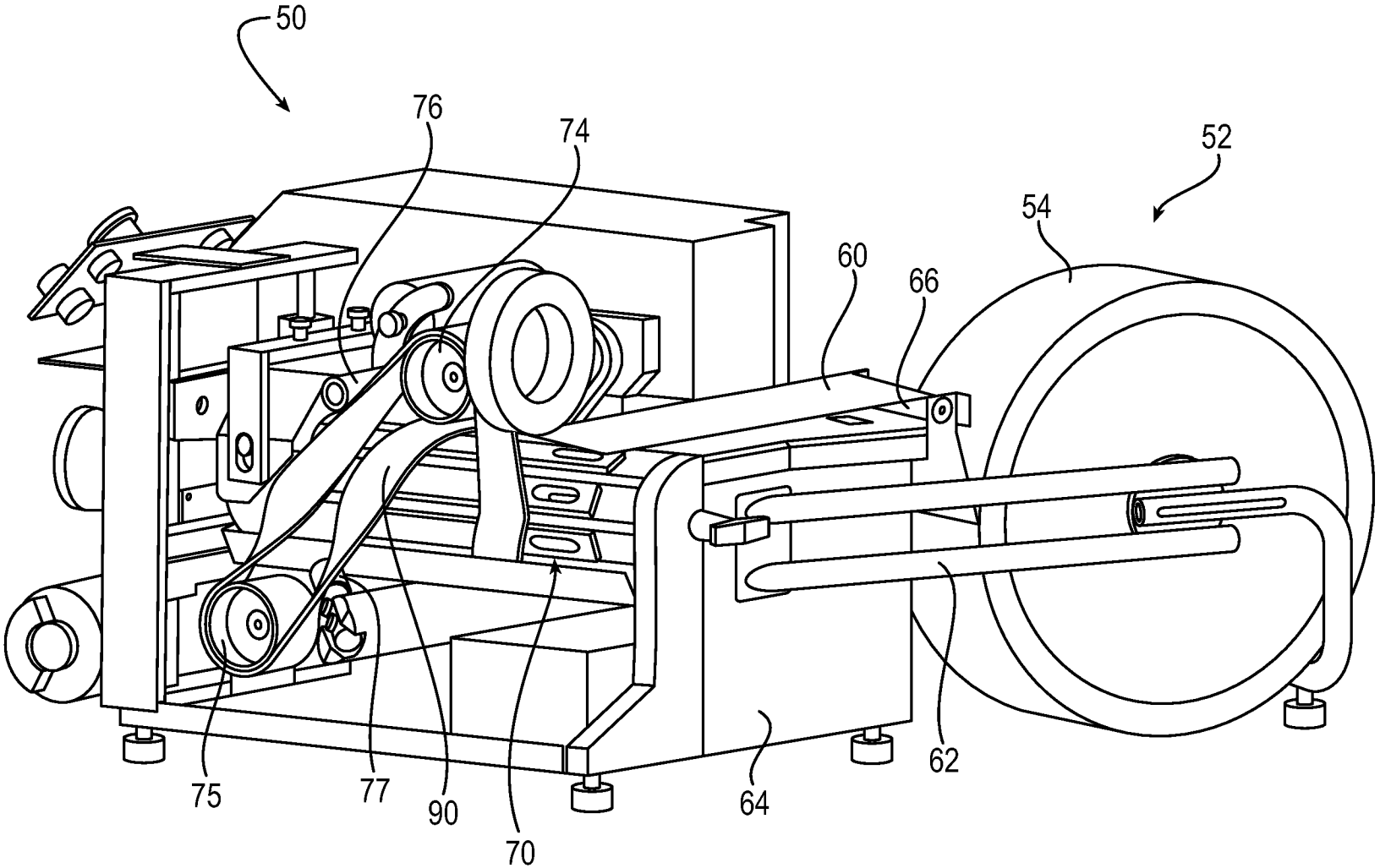
FIG. 4 is a side perspective view of the dunnage conversion machine of FIG. 1 with a cover removed to show interior components.
Figure 5:
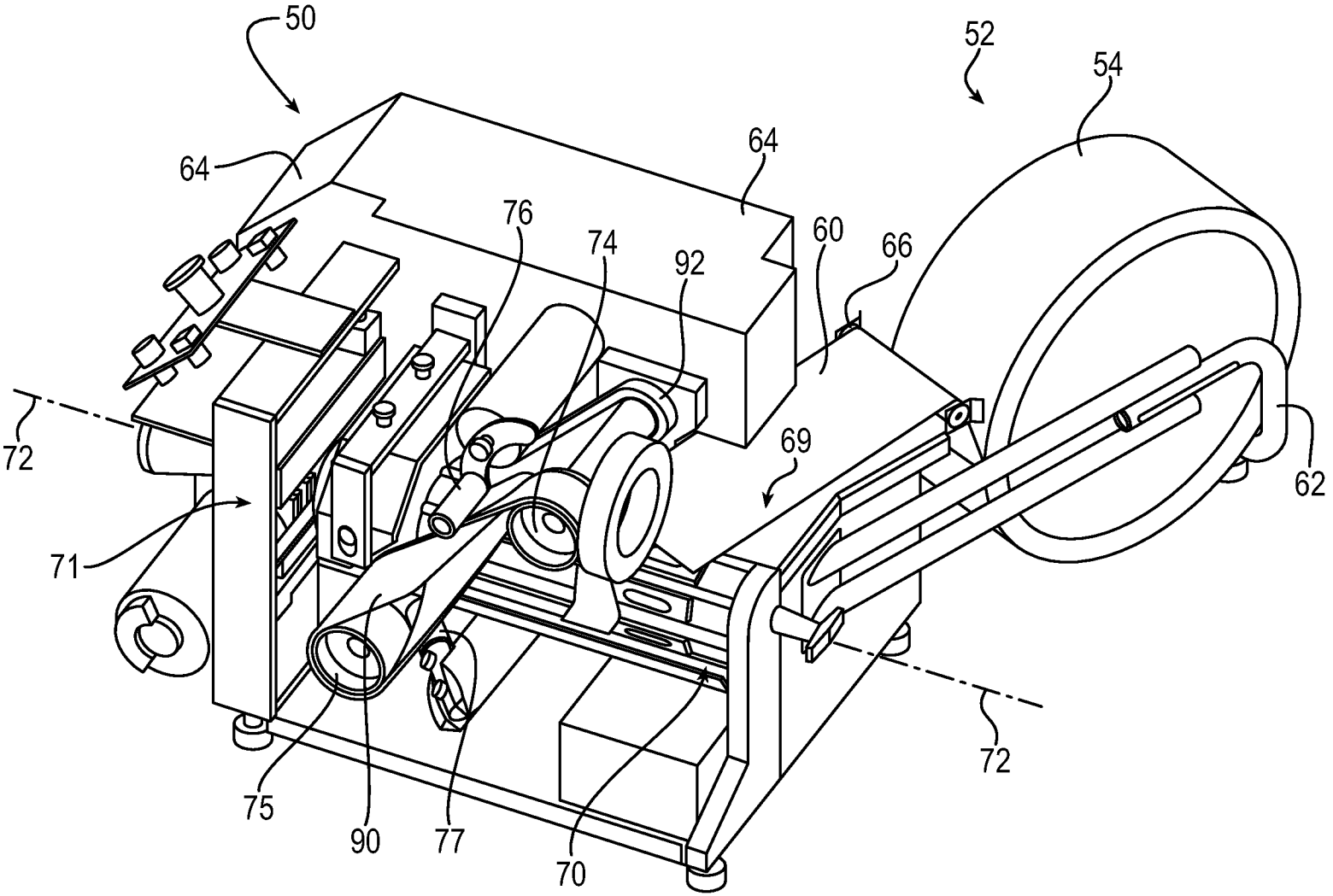
FIG. 5 is a top perspective view of the dunnage conversion machine of FIG. 4.
Figure 6:
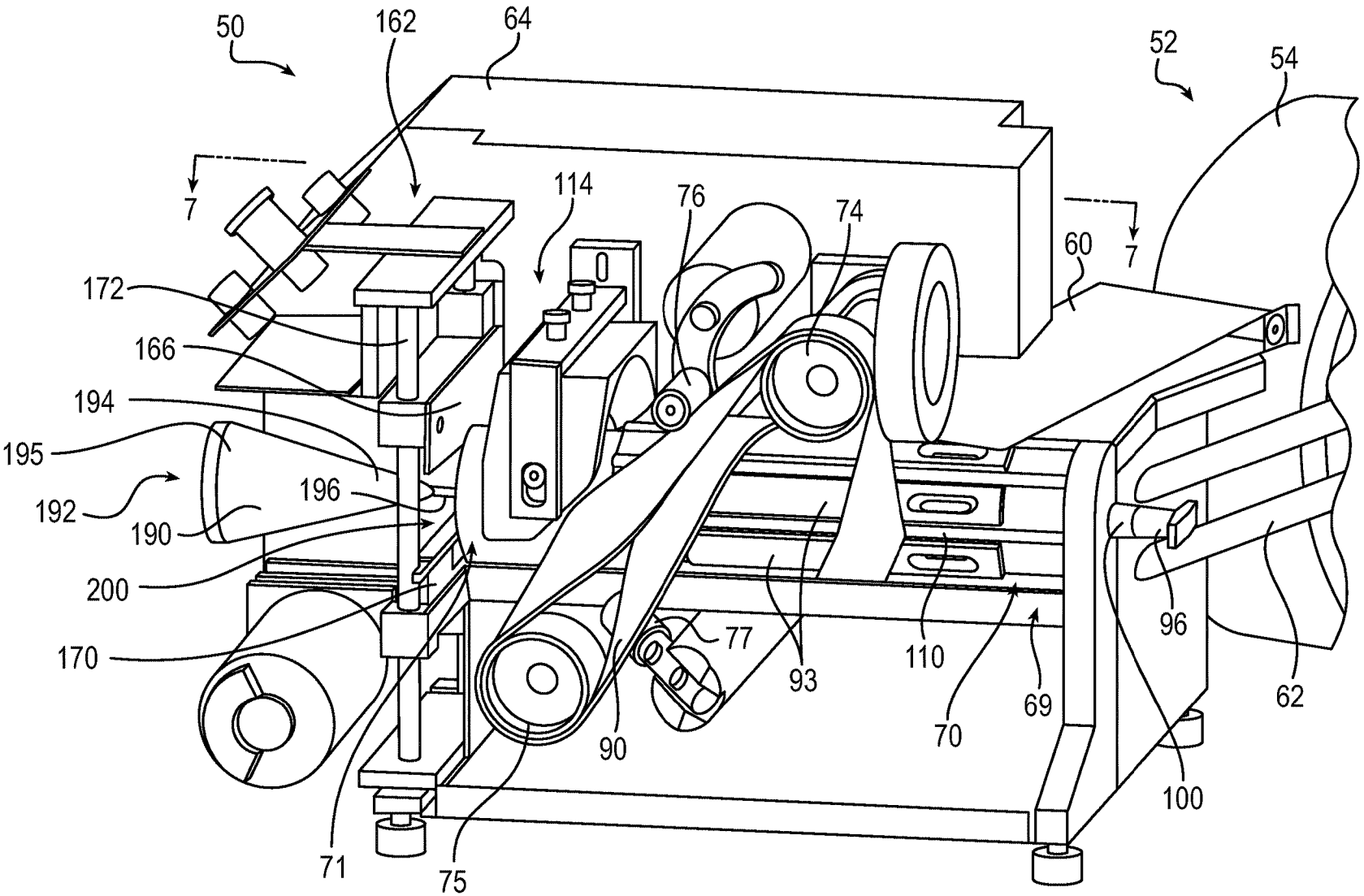
FIG. 6 is an enlarged perspective view of the dunnage conversion machine of FIG. 4.

Referring now to the drawings, the present invention provides a dunnage conversion machine and method for producing a crumpled dunnage product. A schematic illustration of the conversion process is shown in FIG. 1. Generally, a substantially continuous strip of sheet stock material 40 is drawn from a supply 42 and helically wound around a mandrel (not shown) having a longitudinal axis 44. The strip of sheet material 40 is joined at its edge to an adjacent, previously-wound section of the strip to form a helical seam 46. As the sheet material 40 advances and spins relative to the longitudinal axis 44, the sheet material 40 is longitudinally and helically crumpled. The strip of sheet material 40 travels a helical path, along and around the longitudinal axis 44 from an upstream end 47 near the stock supply 42 to a downstream end 49 opposite the upstream end 47. In other words, the strip of sheet material 40 spins around the longitudinal axis 44 as the sheet material advances parallel to the longitudinal axis 44. Although this may commonly be thought of as a spiral path, a spiral has a continuously-changing radius relative to an axis of rotation, whereas a helix has a constant radius as it winds around the longitudinal axis 44. This process produces a continuous length of dunnage, spinning about the longitudinal axis 44, from which sections are separated to form discrete dunnage products 48.

The resulting dunnage product 48 thus comprises a sheet 40 wound along a helical path into a helical configuration, with adjacent edge portions joined together to form a helical seam 46. The sheet material is permanently deformed by randomly disposed helical and circumferential folds in the sheet. The helical seam 46 adds strength and helps dunnage product 48 maintain its shape.

An exemplary sheet stock material 60 is approximately 90 mm to 150 mm wide, with an adhesive strip of approximately 10 mm to 15 mm along one edge. This sheet stock material can be used to form a dunnage product with a diameter of about 80 mm to 100 mm. An exemplary sheet stock material is paper, such as kraft paper, with a basis weight of approximately 120 gsm.

An exemplary embodiment of a dunnage conversion machine 50 provided by the invention is shown in FIGS. 2-6. The machine 50 is very compact and can be supported on a tabletop, along with a supply 52 of sheet stock material. In the illustrated embodiment, the supply 52 of sheet stock material includes a roll 54 of sheet stock material. Alternatively, the roll 54 can be replaced by a stack of fan-folded sheet material. An exemplary sheet material is paper, and particularly kraft paper, which is an environmentally-friendly stock material that is recyclable, burnable or compostable, and is made from a renewable resource.

The stock roll 54 is mounted on a shaft 56 passing through a central core of the stock roll 54 to support the stock roll 54 and about which the stock roll 54 rotates as the strip of sheet material 60 is fed from the supply 52. The shaft 56 is part of a frame 62, which is mounted to a housing 64 of the machine 50 so as to be integral with the machine 50. The position of the shaft 56 is adjustable relative to the frame 62, but not its orientation. The frame 62 and the shaft 56 are mounted in a fixed orientation to direct the strip of sheet material 60 into the machine 50 at the proper angle. One or more guides may be provided, however, to guide the strip of sheet material into the machine 50, including rollers or turner bars, etc. A single guide roller 66 is shown in the illustrated embodiment.

The guide roller 66 guides the strip of sheet material 60 as it enters the housing 64 and follows a helical path around and along a mandrel 70. The mandrel 70 is approximately cylindrical and has a longitudinal axis 72. The guide roller 66 has an axis that is transverse the longitudinal axis 72 of the mandrel 70 to guide the strip of sheet stock material 60 from the supply 52 to the mandrel 70 along a path that intersects the longitudinal axis 72 of the mandrel 70 at an acute angle relative to the longitudinal axis 72. A drive assembly provides the motive force to move the sheet material 60 along that helical path from an upstream end of the mandrel 70 and along and around the mandrel 70 to a downstream end of the mandrel 70. The sheet material winds around the mandrel 70 at a non-perpendicular angle relative to the longitudinal axis 72, forming an acute angle with the longitudinal axis 72 on an upstream side.

As the strip 60 winds around the mandrel, adjacent edges of adjacent windings can overlap or abut, edge-to-edge. The adjacent windings are joined together with an adhesive, optionally provided in the form of a tape, a hot-melt applicator, a cohesive, or a spray or roll-on adhesive, to name a few examples, to form a pre-form, which spins about the longitudinal axis 72 as it advances and crumples. Alternatively, the adjacent windings can be mechanically connected, such as with interlocking tabs formed in the adjacent windings. Accordingly, the machine 50 provided by the invention can further include the necessary components to apply the tape or adhesive, if the adhesive or cohesive material is not pre-applied to the sheet stock material 60. An exemplary sheet stock material 60 can be provided as a fan-folded stack or in the form of a roll, such as that shown, with an adhesive provided adjacent one edge, preferably approximately the width of the anticipated overlap with an adjacent winding.

The drive assembly includes multiple rollers 74, 75, 76, and 77 and a continuous-loop drive belt 90 that wraps around the mandrel 70. The belt 90 both pulls the sheet material onto the mandrel 70 and moves the sheet material along the mandrel 70 in a downstream direction parallel to the longitudinal axis 72, and in a helical path around the mandrel 70. At least one of the rollers 74, 75, 76, and 77 is a drive roller that is driven by a motor (not shown). The illustrated embodiment includes two drive rollers 74 and 75 that are connected to the motor through a drive chain 92 (more clearly seen in FIG. 7). The other rollers, idler rollers 76 and 77 guide the drive belt 90 between the driven rollers 74 and 75 and the mandrel 70. The position of the idler rollers 76 and 77 is adjustable to maintain tension on the drive belt 90. The mandrel 70 does not rotate, despite being wrapped by the movable drive belt 90. Friction between the drive belt 90 and the strip of sheet material 60 is what moves the strip 60 along and around the mandrel 70.

Referring now to FIGS. 6-11, an upstream segment 91 of the mandrel 70 has an adjustable effective diameter to facilitate loading a fresh strip of sheet material 60 and to increase the tension on the drive belt 90 in normal operation. The adjustable-diameter segment 91 of the mandrel 70 is hollow and includes multiple camming elements 93 that can retract to reduce the effective diameter of the mandrel 70 or can be extended to increase the effective diameter of the mandrel 70. Control over the position of the camming elements 93, and thereby the diameter of the mandrel 70, is effected through a control rod 94 that extends out of the housing 64 from within the mandrel 70. The end of the control rod 94 has a handle 96 to facilitate manipulation of the control rod 94 by the operator.

A sensor 100 detects the position of the control rod 94. The sensor 100 is connected to a controller 102. The controller 102 can include a microprocessor, a memory, and pre-programmed operating instructions saved in the memory for execution by the microprocessor. The controller 102 is configured to control operation of the drive motor and the speed at which the drive belt 90 advances the strip of sheet material 60 based on the signal from the sensor 100. A signal from the sensor 100 that the control rod 94 is in an extended loading position, for example, can be used to prevent the operator from driving the drive belt 90 at its highest speed, slowing down the drive belt 90 for loading until another sensor 160 (FIG. 18) near the outlet of the machine 50 detects the presence of the sheet material. Once the downstream sensor 160 (FIG. 18) detects the sheet material, the handle 96 can be pushed inward to an operating position to permit normal operation of the machine 50 and a higher speed of the drive belt 90.

In normal operation, the handle 96 and the control rod 94 are pushed inward, toward the mandrel 70. A pair of cam blocks 104 inside the mandrel 70 are attached to the control rod 94. These cam blocks 104 cooperate with cam surfaces 106 on the camming elements 93 to push the camming elements 93 outward against the drive belt 90. To reduce friction between the mandrel 70 and the drive belt 90 when no strip of sheet material 60 is present between them, such as during an initial loading operation, the handle 96 and the control rod 94 are pulled outward relative to the housing 64. Moving the control rod 94 outward moves the cam blocks 104 along the cam surfaces 106 to allow the camming elements 93 to retract under pressure applied by the drive belt 90. This reduces the friction between the drive belt 90 and the mandrel 70, which helps to protect the drive motor and facilitates the introduction of the strip of sheet material 60 between the drive belt 90 and the mandrel 70.

To further reduce the tension, the surface area of the mandrel 70 is reduced by the provision of a plurality of longitudinally-extending protuberances 110 that extend from the surface of the mandrel 70 to a diameter that is slightly less than effective diameter provided by the camming elements 93 in their extended position. When the camming elements 93 retract, the drive belt 90 slides against these protuberances rather than the entire surface of the mandrel 70. And when the strip of sheet material 60 is being fed into the machine 50, the sheet material is gripped between the protuberances 110 and the drive belt 90 as the drive belt 90 moves the sheet along its helical path A distal or downstream end of the mandrel 70 has a reduced-diameter segment 112 that is coupled to the adjustable-diameter segment 91 of the mandrel 70 that was just described. This reduced-diameter segment 112 lacks the camming elements 93 of the adjustable-diameter segment 91, and is rotatable relative to the adjustable-diameter segment 91. The reduced-diameter segment 112 also has a smaller diameter than the smallest diameter of the adjacent adjustable-diameter segment 91. The smaller diameter of the reduced-diameter segment 112 facilitates crumpling of the sheet material of the pre-form. Thus, the drive belt 90 extending around the mandrel 70 can be referred to collectively as a helical pre-form assembly.

A restriction 114 extends into the helical path of the strip of sheet material 60 or pre-form adjacent the reduced-diameter segment 112 of the mandrel 70, slowing the advance of the sheet material and causing it to randomly crumple between the restriction 114 and mandrel 70.

Figure 12:
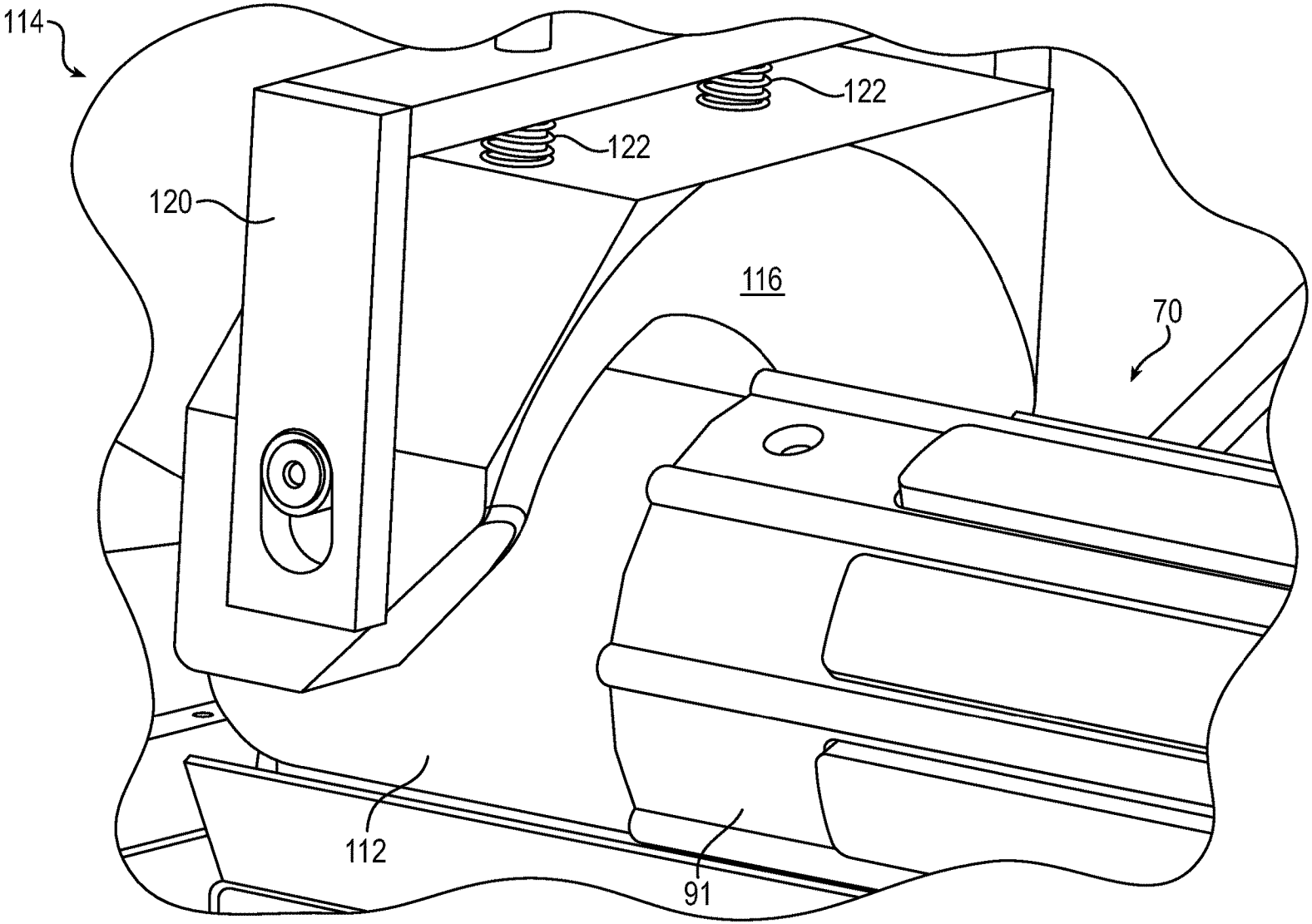
FIG. 12 is an enlarged perspective view of a restriction portion of the dunnage conversion machine of FIG. 6.

Referring now also to FIG. 12, the restriction 114 presents a curving interface surface 116 to the mandrel 70. An upstream end of the interface surface 116 is further from the mandrel 70, and the interface surface 116 curves downward toward the mandrel 70 to extend into the path of the sheet material in the downstream direction. Thus the sheet material typically will initially pass between the interface surface 116 and the mandrel 70 (specifically, the reduced-diameter segment 112) before engaging the interface surface 116. Put another way, the restriction 114 has a cross-section along the longitudinal axis 72 that defines a larger gap between the restriction 114 and the mandrel 70 at an upstream side of the restriction 114 and a smaller gap between the restriction 114 and the mandrel 70 at a downstream side of the restriction 114.

The restriction 114 also extends around the mandrel 70 to interfere with the uninterrupted passage of the sheet material across more than just one contact point around the circumference of the mandrel 70. The restriction 114, and thus the interface surface 116, is biased toward the mandrel 70 and is movable between a position adjacent the mandrel 70 and a position further from the mandrel 70 to allow crumpled sheet material to pass. In the illustrated embodiment, the restriction 114 includes a frame 120 that supports the interface surface 116 and a pair of springs 122 are interposed between the frame 120 and the interface surface 116 to allow the interface surface 116 to move toward or away from the mandrel 70 depending on the pressure applied by the crumpled sheet material as it passes by the restriction 114.

Figure 13:
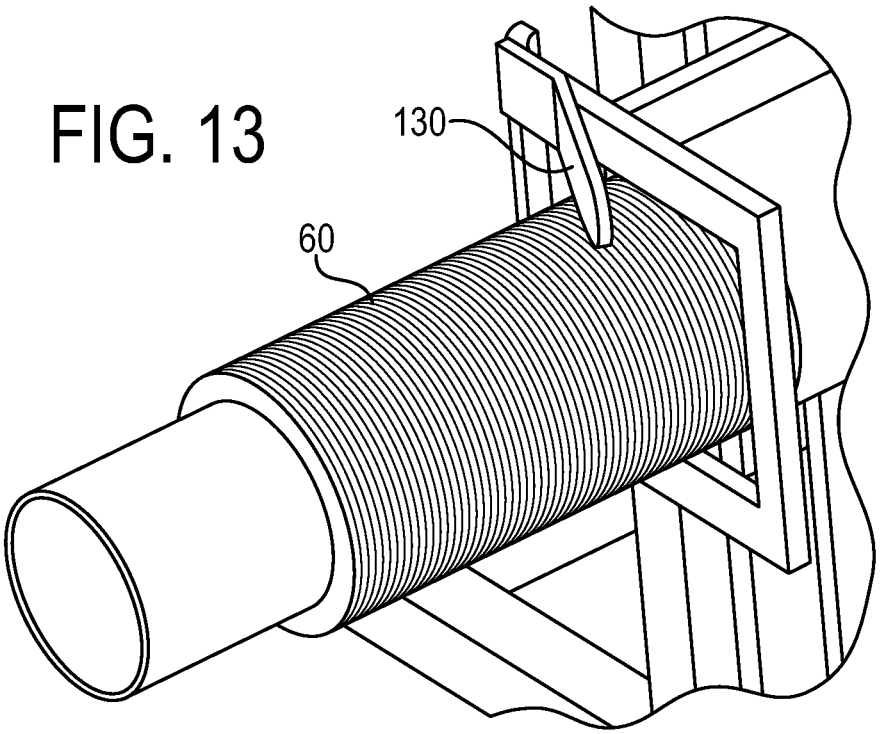
FIGS. 13-17 are perspective views of alternative restriction portions for a dunnage conversion machine provided by the invention.
Figure 14:
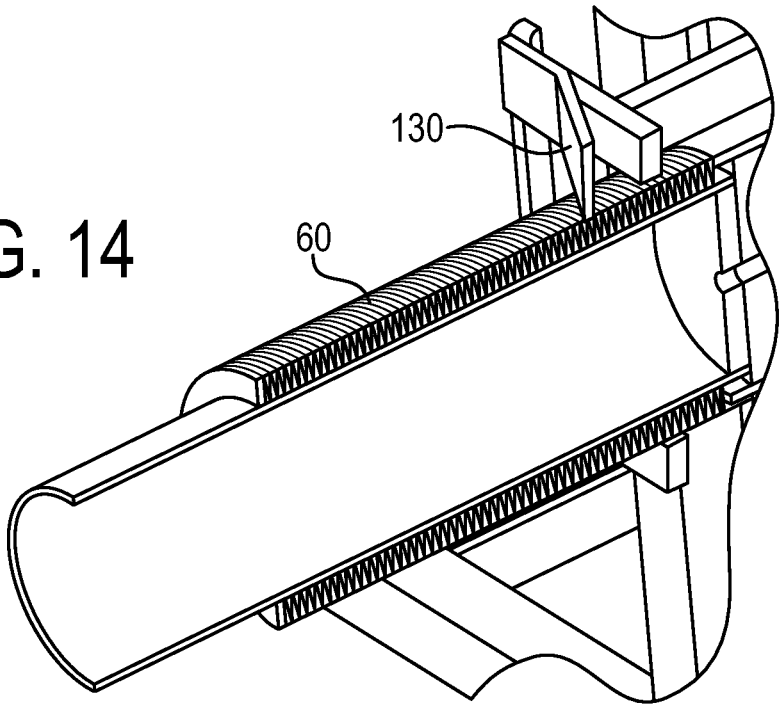
Figure 15:
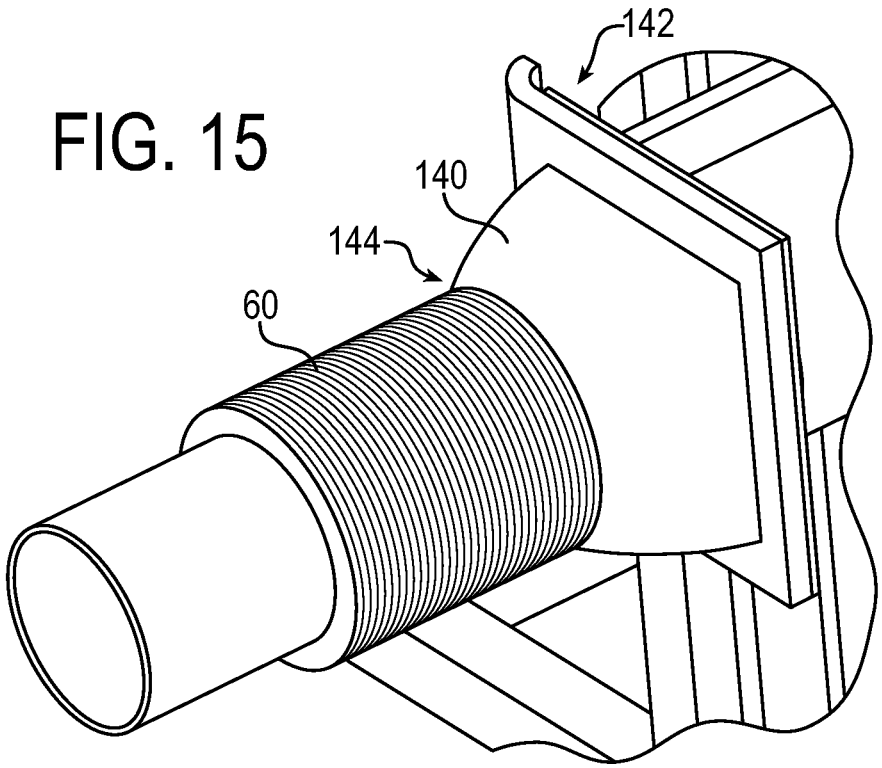
Figure 16:
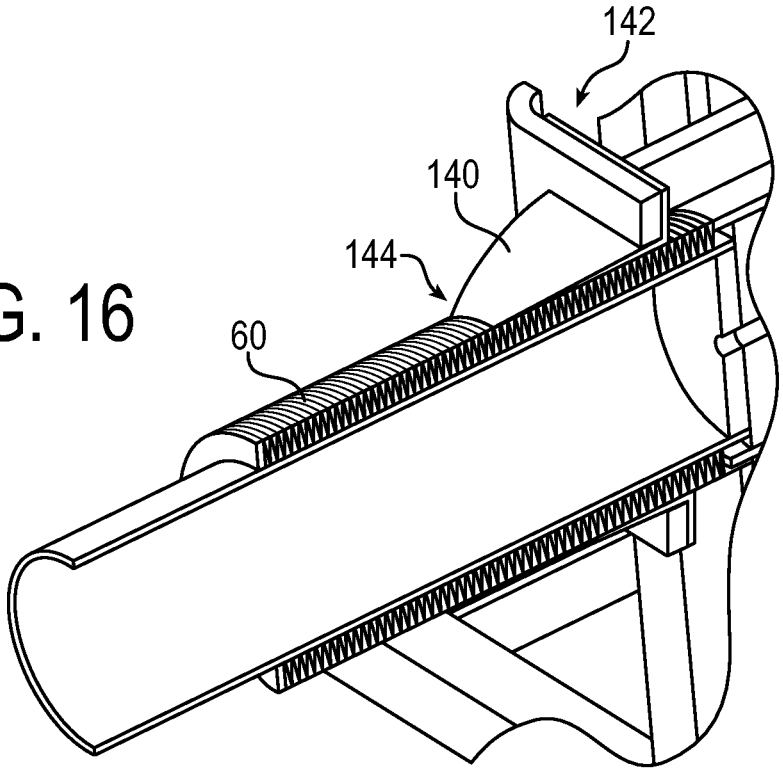
Figure 17:
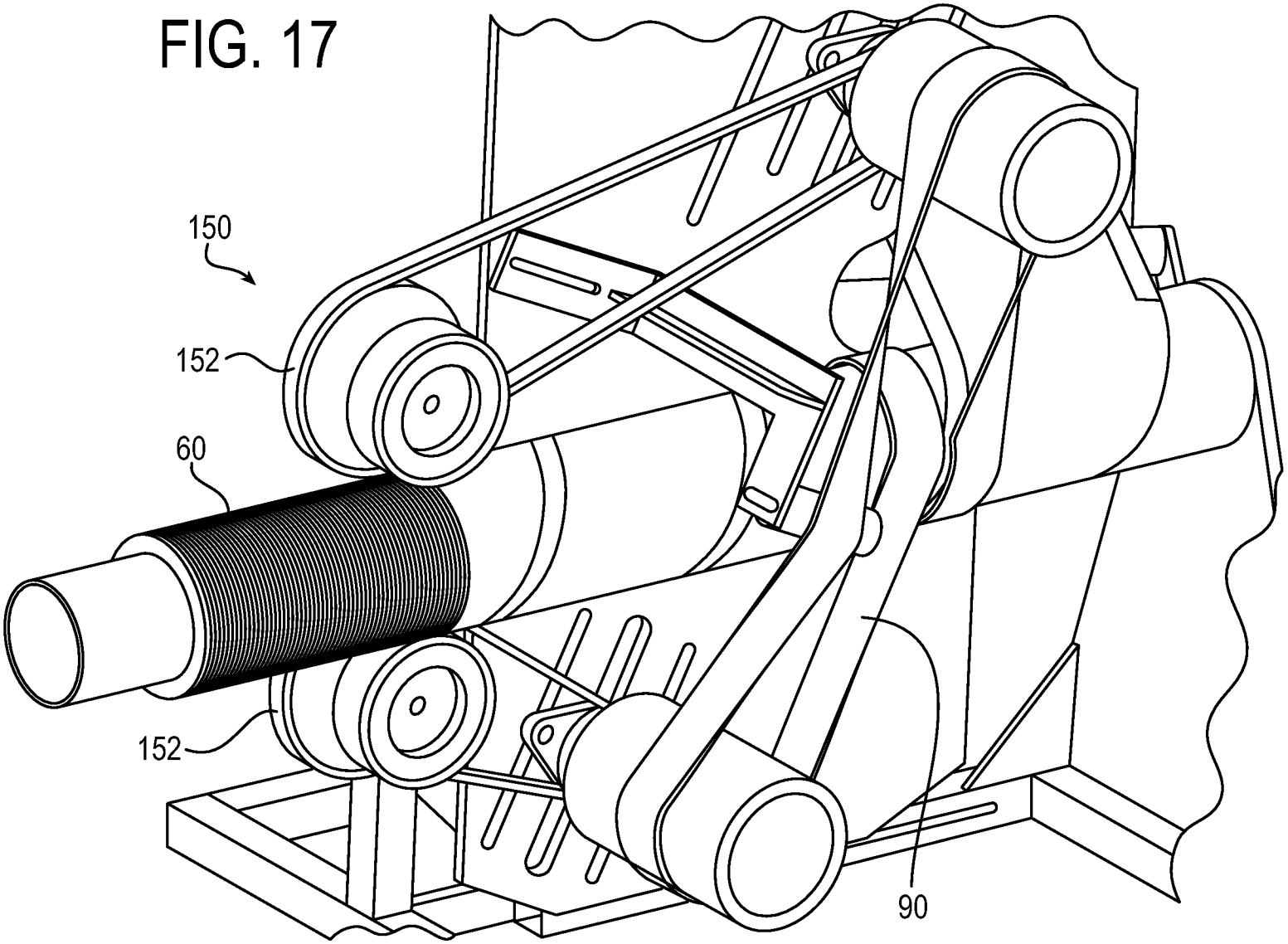

Several alternative restriction designs are shown in FIGS. 13-17. In FIGS. 13 and 14, the restriction is provided by a finger 130 that extends into the path of the sheet material 60. Even this one contact point can be sufficient to slow the advance of the sheet material and cause the sheet material to randomly crumple as it spins and moves past the finger restriction 130. In FIGS. 15 and 16, the restriction is provided by an elastic cuff or grommet 140 that extends into the path of the sheet material 60, presenting a wider mouth at an inlet end 142 to receive the sheet material, and narrowing to a smaller outlet at an outlet end 144 that extends into the path of the sheet material around the entire circumference of the mandrel. Friction between the elastic grommet 140 and the sheet material leads to random crumpling. And FIG. 17 illustrates a powered restriction 150, where one or more driven rollers 152 are positioned within the path of the sheet material 60. The rollers 152 are driven to pass the sheet material thereby at a slower rate than the drive belt 90 is advancing the sheet. Consequently, the sheet material backs up and randomly crumples adjacent those rollers 152. Although two rollers 152 are used in the illustrated embodiment, more or fewer rollers may be sufficient to provide the desired crumpling.

Figure 7:
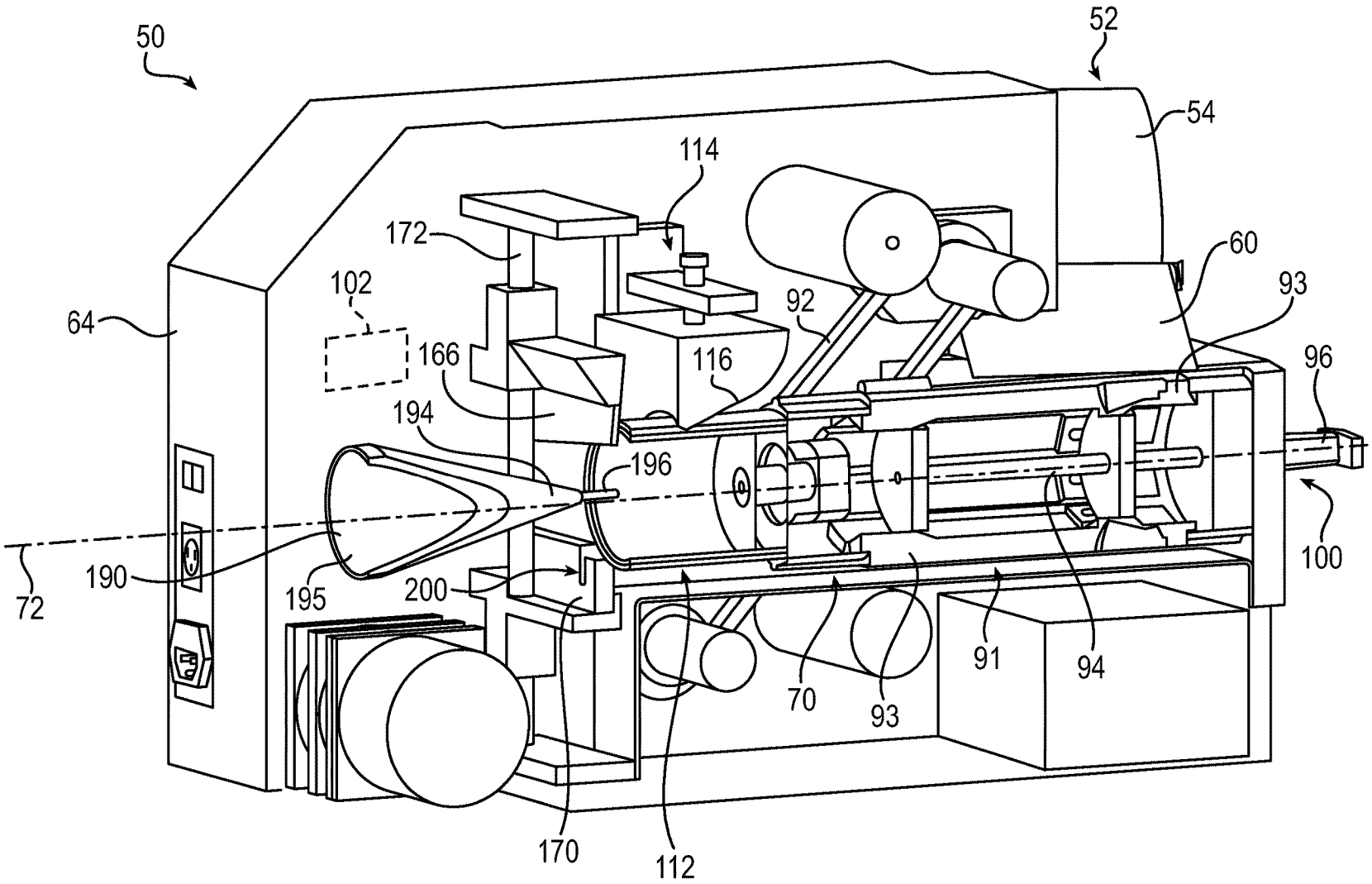
FIG. 7 is a perspective view of a cross-section of the dunnage conversion machine of FIG. 4 along a longitudinal axis.
Figure 8:
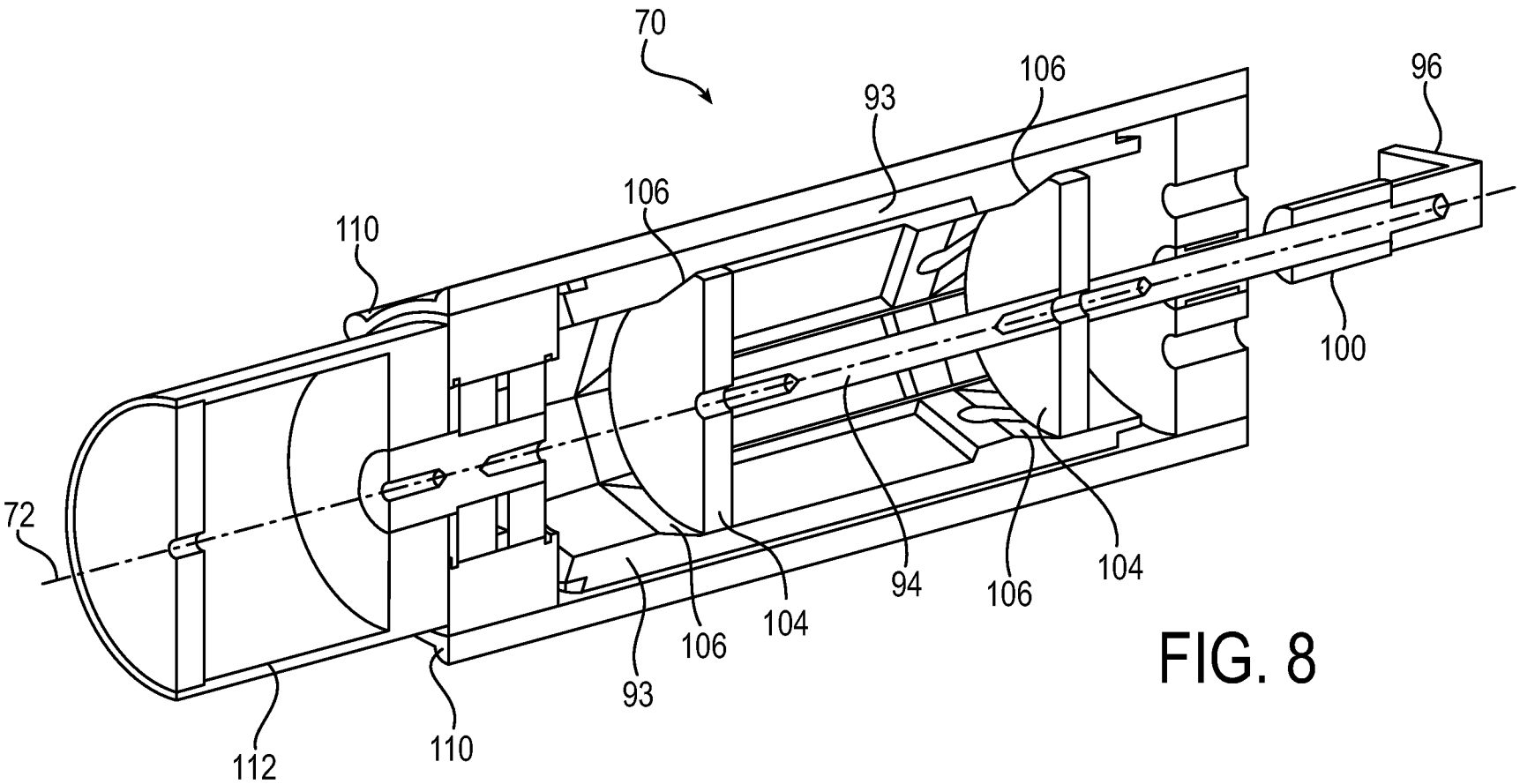
FIG. 8 is a perspective view of a cross-section of a mandrel portion of the dunnage conversion machine of FIG. 6 along a longitudinal axis, in a loading configuration.
Figure 9:
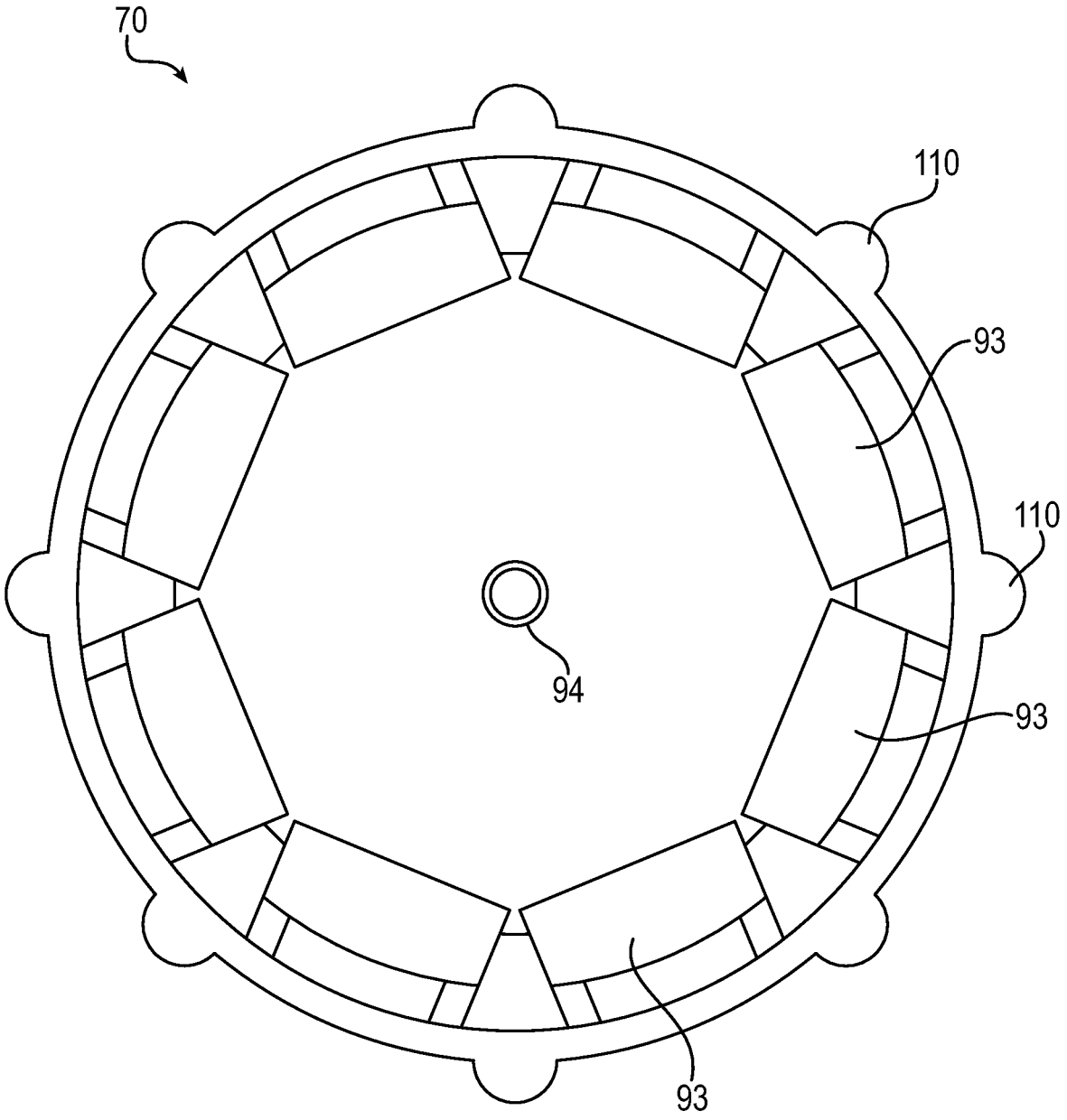
FIG. 9 is a cross-sectional view of the mandrel of FIG. 8, perpendicular to the longitudinal axis.
Figure 10:
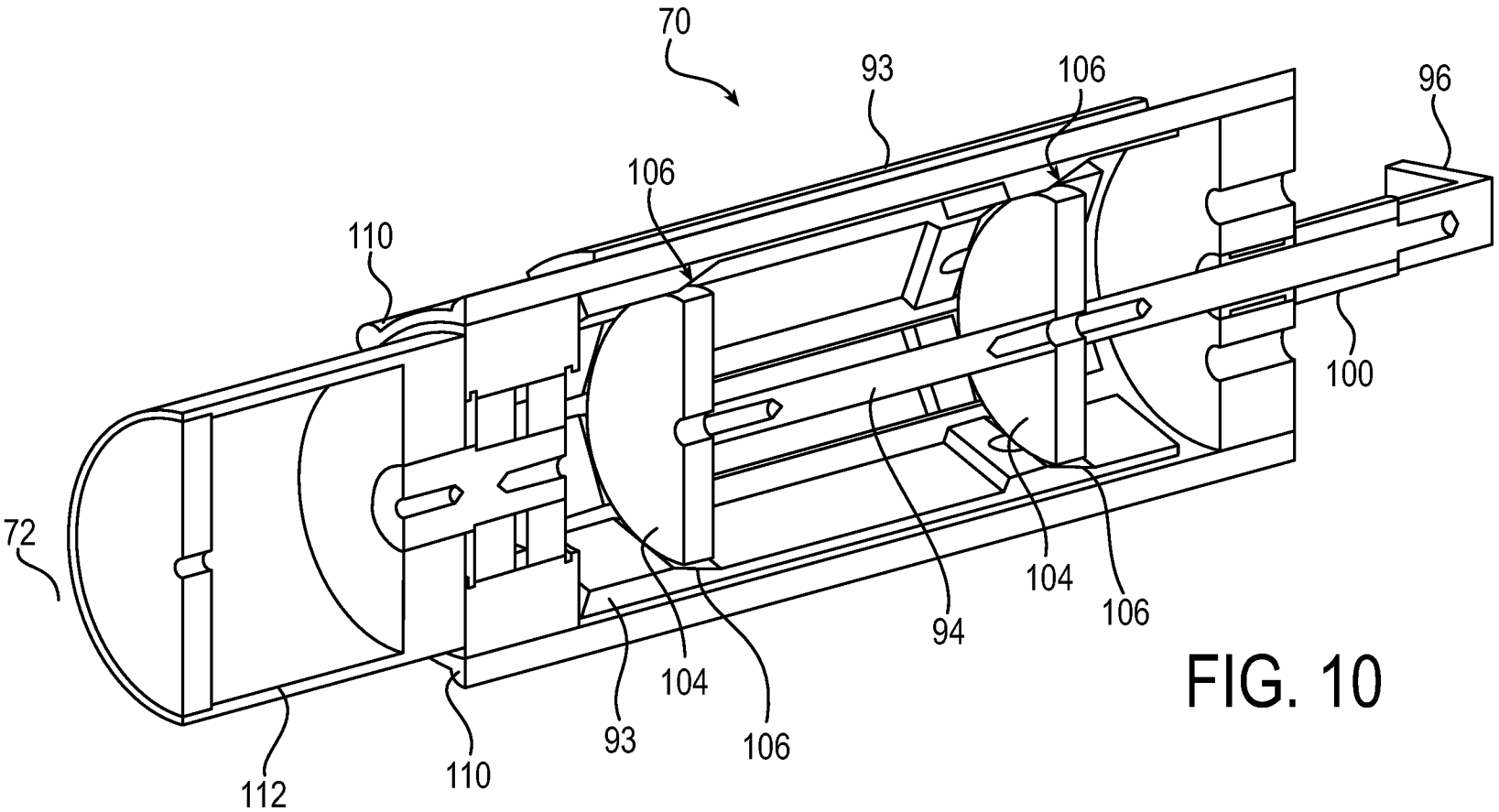
FIG. 10 is a perspective view of a cross-section of a mandrel portion of the dunnage conversion machine of FIG. 6 along a longitudinal axis, in an operating configuration.
Figure 11:
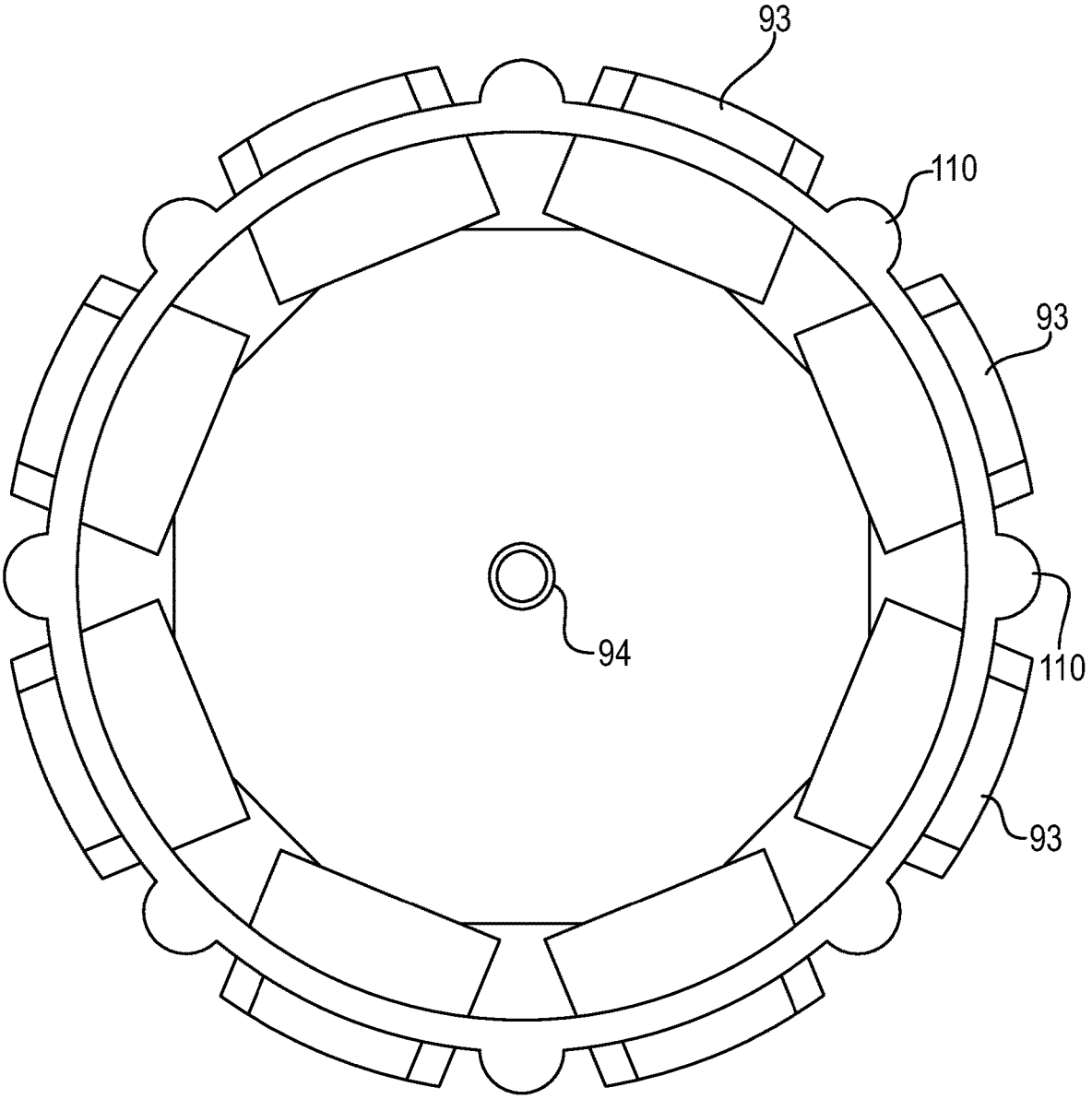
FIG. 11 is a cross-sectional view of the mandrel of FIG. 10, perpendicular to the longitudinal axis.
Figure 18:
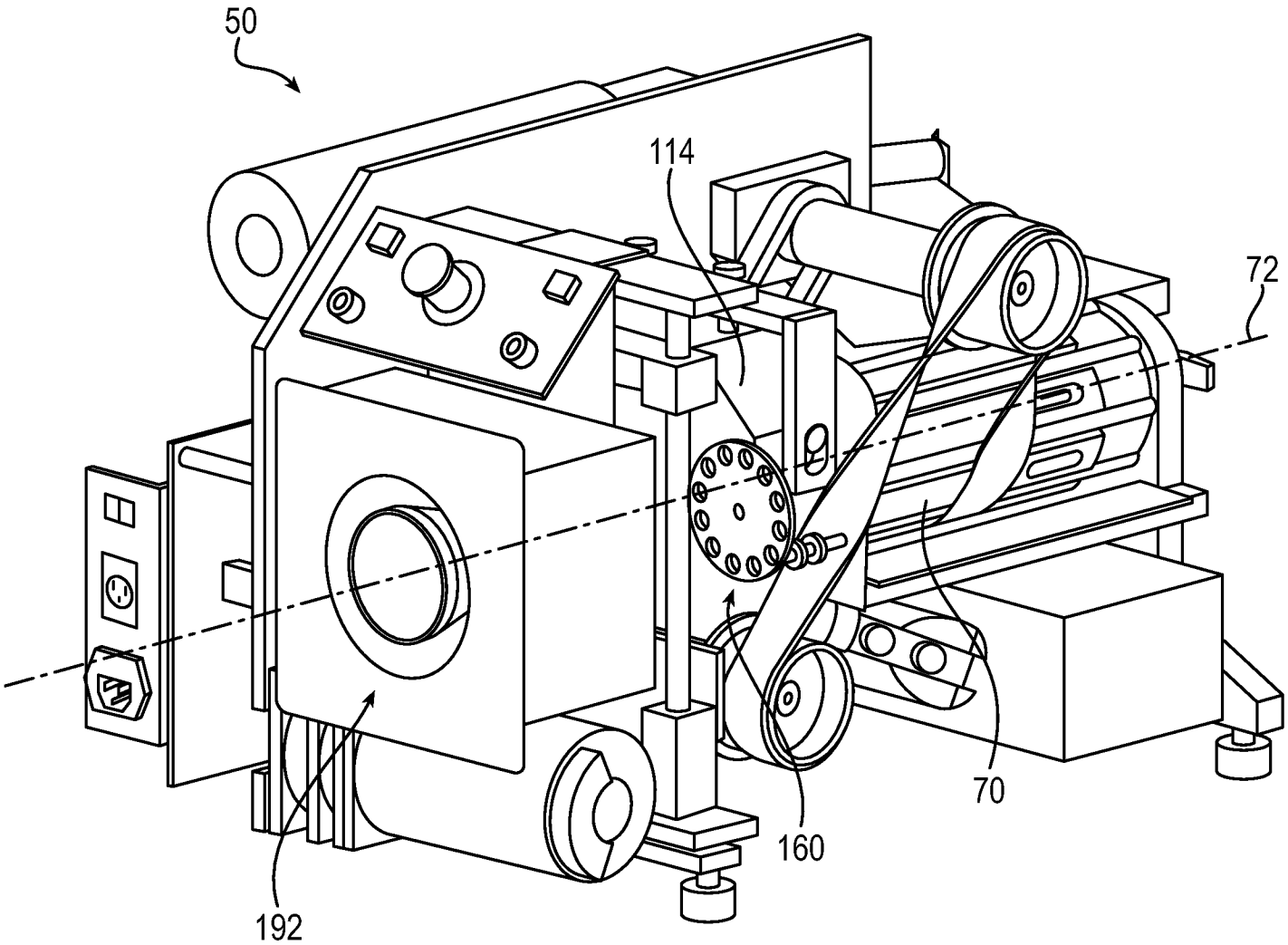
FIG. 18 is another perspective view of a dunnage conversion machine provided by the invention.
Figure 19:
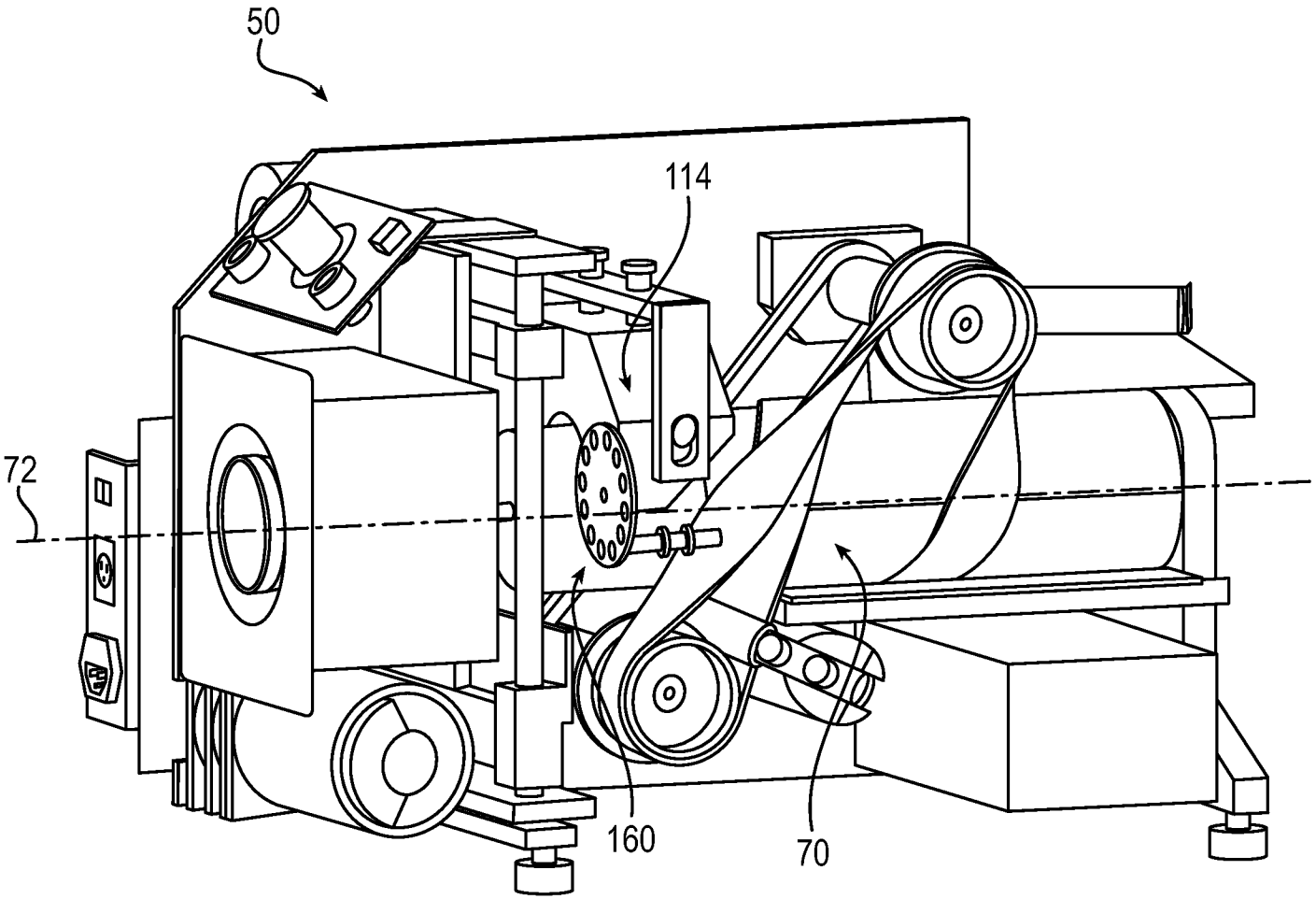
FIG. 19 is another perspective view of the dunnage conversion machine of FIG. 18.

Returning now to the exemplary embodiment of FIGS. 2-7, and also considering FIGS. 18 and 19, the downstream sensor 160 mentioned above is shown. The downstream sensor 160 shown in FIGS. 18 and 19 is a wheel sensor for detecting the presence of sheet material just downstream of the restriction 114. When crumpled sheet material passes the restriction 114, the passage of the crumpled dunnage, rotating along its helical path, will engage the wheel sensor 160. The wheel sensor 160 rotates about an axis that is parallel the longitudinal axis 72, and is spaced from the mandrel 70 so that the rotatable reduced-diameter segment 112 of the mandrel 70 will not cause the wheel sensor 160 to rotate, but it is close enough to the mandrel 70 that the rotating crumpled sheet material will engage the wheel sensor 160. The wheel sensor 160 also can be connected to the controller 102 (FIG. 7). The controller can use the wheel sensor output to detect a jam, such as from a blockage of crumpled sheet material adjacent the wheel sensor 160 that is no longer rotating. The wheel sensor output also can detect the absence of crumpled sheet material, such as from the end of the strip of sheet material passing the wheel sensor 160 or from a jam occurring upstream of the wheel sensor 160, such as during a loading operation. The wheel sensor 160 generally does not inhibit the passage of crumpled sheet material as it leaves the mandrel 70.

From the mandrel 70, the crumpled sheet material passes a separating assembly 162. The strip of sheet material 60 drawn from the supply 52 provides for the production of a continuous crumpled sheet. Since the end of the strip 60 can be spliced to a leading end of a new strip of sheet material from a replenished supply, such as with tape 164 (FIG. 3), the length of dunnage that can be produced is unlimited. To produce dunnage products of a desired length, the separating assembly 162 separates discrete lengths from the continuous crumpled strip of sheet material. In the illustrated embodiment, this is accomplished by a cutting mechanism 162, which has a movable blade 166 and a movable stop 170 past which the blade 166 closely moves to sever the sheet material therebetween as the stop 170 and the cutting blade 166 move toward one another along a pair of guide rails 172. The stop 170 moves farther than the blade 166 during this process, for reasons that will be explained below.

Figure 22:
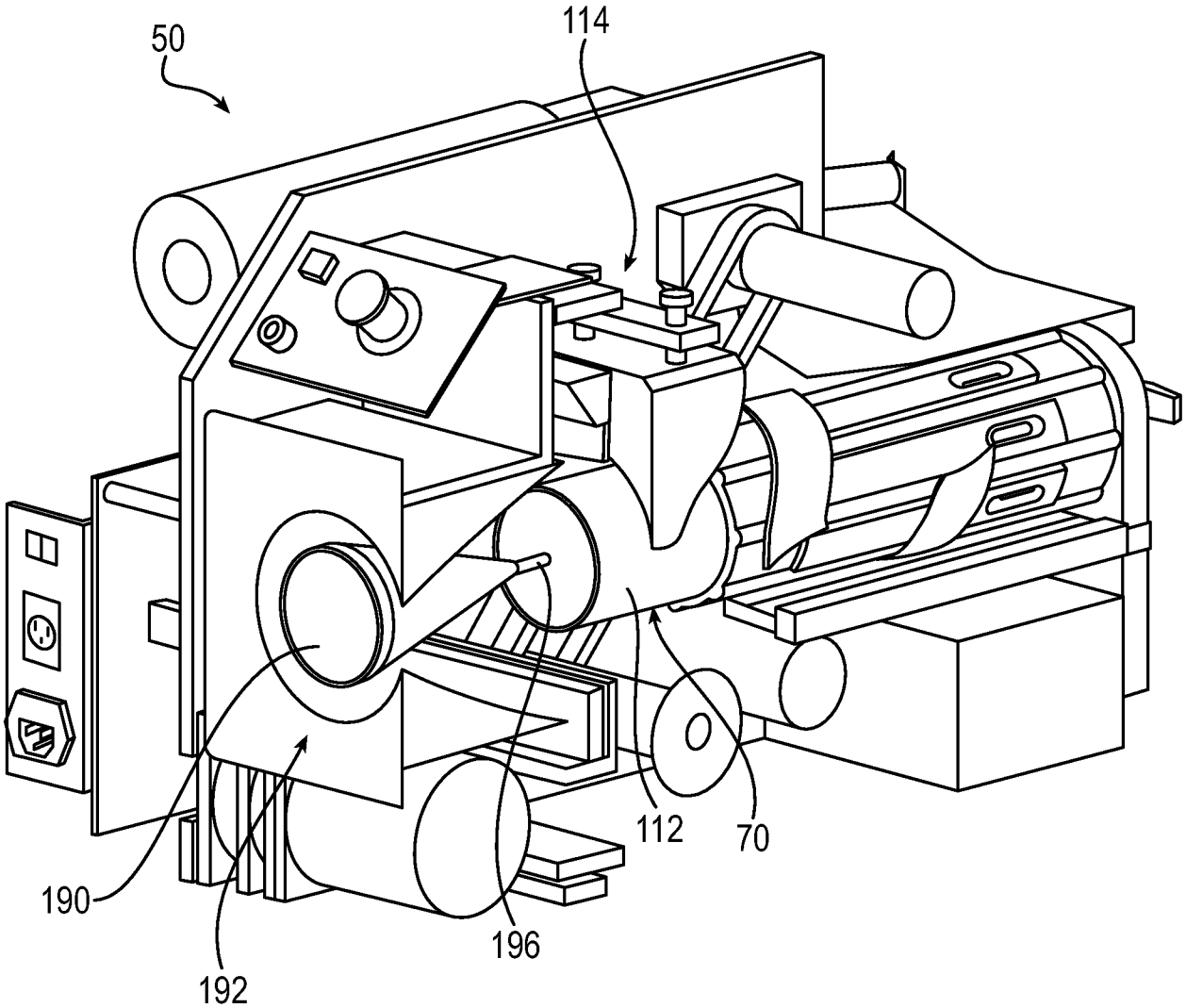
FIG. 22 is another perspective view of a dunnage conversion machine provided by the invention.

Referring now also to FIG. 22, from the separating assembly 162, the crumpled dunnage moves over an expanding cone 190 toward an outlet 192 of the machine 50 and its housing 64. The expanding cone 190 presents its apex or a reduced-diameter end 194 to the mandrel 70 and is the first portion of the cone 190 that the crumpled sheet material encounters before moving over a second portion 195 of the cone 190 with an increasing diameter. The expanding cone 190 serves several purposes. First, when the cutting mechanism 162 cuts the crumpled sheet, the cutting mechanism 162, and particularly the stop 170, tends to flatten the crumpled sheet. The expanding cone 190 restores the loft or air space captured within the helically-wound sheet that forms the dunnage product. Second, the cone 190 cooperates with the housing 64 to define a narrow gap at the outlet 192 to prevent objects from being inserted into the outlet 192 that might be damaged by or cause damage to the machine 50.

The cone 190 is supported in this orientation by a bolt 196 or other connection between the smaller-diameter first portion 194 of the cone 190 and the distal end of the mandrel 70. A notch 200 in the stop portion 170 of the cutting mechanism 162 allows the stop 170 to move past the bolt 196 to ensure that it can cooperate with the blade 166 to sever of the crumpled sheet.

Finally, an alternative cutting mechanism 202 is shown in FIGS. 20 and 21. In this embodiment, the cutting mechanism 202 includes a pair of semi-circular cutting blades 203 and 204 that move together and partially past each other to overlap and ensure complete separation of a length of the crumpled sheet 206. Because the semi-circular cutting blades 203 and 204 present a cutting edge around the entire circumference of the crumpled sheet 206, the movement of the cutting blades 203 and 204 is relatively short, providing a quicker cutting operation. A pair of pivoting linkages 210 and 212 are used to drive the scissoring action of the cutting blades 203 and 204.

In summary, the present invention provides a machine 50 for converting a sheet stock material 60 into a relatively less dense dunnage product 48 (FIG. 1). The machine 50 includes both (a) a helical pre-form assembly having a cylindrical mandrel 70 with a longitudinal axis 72 and a guide member 56 or 66 for guiding the sheet stock material 60 from a supply 52 thereof into a helical path along and around the mandrel 70 so as to form a helical pre-form that rotates around the longitudinal axis 72 and advances parallel to the longitudinal axis 72; and (b) a restriction 114 in the path of the pre-form that slows the advance and rotation of the pre-form past the restriction 114, the restriction 114 causing the pre-form to retard longitudinal advancement, to twist upon itself, and to permanently deform as it moves past the restriction 114, thereby longitudinally and helically crumpling the pre-form to form a crumpled dunnage product.

Although the invention has been shown and described with respect to certain preferred embodiments, it is obvious that equivalent alterations and modifications will occur to others skilled in the art upon the reading and understanding of this specification and the annexed drawings. In particular regard to the various functions performed by the above described components, the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention can have been disclosed with respect to only one of the several embodiments, such feature can be combined with one or more other features of the other embodiments as may be desired and advantageous for any given or particular application.

What is claimed is:

1. A machine for converting a sheet stock material into a relatively less dense dunnage product, comprising:

a helical pre-form assembly having a cylindrical mandrel with a longitudinal axis; and a guide member for guiding the sheet stock material from a supply thereof into a helical path along and around the mandrel so as to form a helical pre-form that rotates around the longitudinal axis and advances parallel to the longitudinal axis;

and a restriction in the path of the pre-form that slows the advance and rotation of the pre-form past the restriction, the restriction causing the pre-form to retard longitudinal advancement, to twist upon itself, and to permanently deform as it moves past the restriction, thereby longitudinally and helically crumpling the pre-form.

2. A machine as set forth in claim 1, where the helical pre-form assembly includes a drive belt extending around the mandrel, the mandrel and the drive belt cooperating to define the helical path for the sheet stock material.

3. A machine for converting a sheet stock material into a relatively less dense dunnage product, comprising:

a helical pre-form assembly having a cylindrical mandrel with a longitudinal axis; and a guide member for guiding the sheet stock material from a supply thereof into a helical path along and around the mandrel so as to form a helical pre-form that rotates around the longitudinal axis and advances parallel to the longitudinal axis;

and a restriction in the path of the pre-form that slows the advance and rotation of the pre-form past the restriction, the restriction causing the pre-form to retard longitudinal advancement, to twist upon itself, and to permanently deform as it moves past the restriction, thereby longitudinally and helically crumpling the pre-form, where the mandrel has a distal end portion with a reduced diameter.

4. A machine as set forth in claim 1, where the restriction includes an interface surface that extends into the path of the pre-form, and the interface surface is spring-biased toward the mandrel and is movable between a position adjacent the mandrel and a position further from the mandrel.

5. A machine as set forth in claim 1, where the longitudinal axis extends from an upstream end of the mandrel where the sheet stock material first engages the mandrel and a downstream end of the mandrel where the pre-form crumples between the distal end portion of the mandrel and the restriction, and the restriction has a cross-section along the longitudinal axis that defines a larger gap between the mandrel and the restriction at an upstream side of the restriction and a smaller gap between the mandrel and the restriction at a downstream side of the restriction.

6. A machine as set forth in claim 1, comprising a guide cone downstream of the restriction, aligned with the mandrel, and oriented with its apex facing the mandrel.

7. A machine as set forth in claim 6, comprising a separating mechanism between the restriction and the guide cone to separate sections of crumpled pre-form to form discrete dunnage products.

8. A machine as set forth in claim 1, comprising a support for a supply of sheet stock material.

9. A machine as set forth in claim 1, comprising a supply of sheet stock material.

10. A machine as set forth in claim 9, where the supply of sheet stock material is provided in the form of a cylindrical roll or a rectangular stack of fan-folded.

11. A machine as set forth in claim 9, comprising a guide having an axis that is transverse the longitudinal axis to guide sheet stock material from the supply to the mandrel along a path that intersects the mandrel at an acute angle relative to the longitudinal axis.

12. A method of making a dunnage product, comprising the steps of:

helically winding a strip of sheet material around a mandrel to form a helical pre-form;

advancing the pre-form along the mandrel in a direction parallel to a longitudinal axis of the mandrel; and longitudinally and helically crumpling the helical pre-form to form a dunnage product.

13. A machine as set forth in claim 12, where the winding step includes advancing a strip of sheet material along a helical path using a drive belt that extends around the mandrel.

14. A machine as set forth in claim 12, where the crumpling step includes restricting the rate of advancement of the helical pre-form to cause the sheet material to crumple.

15. A method as set forth in claim 12, comprising the step of separating discrete sections of the crumpled sheet material after the crumpling step.

* * * * *